US007195570B2

(12) United States Patent
Hanada et al.

(10) Patent No.: US 7,195,570 B2
(45) Date of Patent: Mar. 27, 2007

(54) GOLF BALL WITH IMPROVED DIRECTIONAL STABILITY IN PUTTING STROKE

(75) Inventors: Hideto Hanada, Nukata-gun (JP); Yutaka Suzuki, Toyokawa (JP); Kimiyo Yoshida, Ichinomiya (JP)

(73) Assignee: Sunrise Enterprise, Nukata-Cho (JP)

( * ) Notice: Subject to any disclaimer, the term of this patent is extended or adjusted under 35 U.S.C. 154(b) by 873 days.

(21) Appl. No.: 10/382,873

(22) Filed: Mar. 7, 2003

(65) Prior Publication Data

US 2003/0211903 A1 Nov. 13, 2003

Related U.S. Application Data

(63) Continuation-in-part of application No. 09/778,813, filed on Feb. 8, 2001, now abandoned.

(30) Foreign Application Priority Data

Mar. 6, 2000 (JP) ..... 2000-060667
May 18, 2000 (JP) ..... 2000-146010

(51) Int. Cl.
*A63B 37/12* (2006.01)

(52) U.S. Cl. ..... 473/383

(58) Field of Classification Search ..... 473/383–385, 473/378

See application file for complete search history.

(56) References Cited

U.S. PATENT DOCUMENTS 906,932 A 12/1908 Riblet
D044,408 S 7/1913 Martin
D047,159 S 3/1915 Kempshall
1,666,699 A 4/1928 Hagen
D075,198 S 5/1928 Young
2,861,810 A 11/1958 Veatch
3,819,190 A 6/1974 Nepela et al.
4,258,921 A 3/1981 Worst
D319,481 S 8/1991 Shaw
5,338,039 A 8/1994 Oka et al.
5,536,013 A 7/1996 Pocklington
5,662,530 A 9/1997 Sellar
5,842,937 A 12/1998 Dalton et al.
6,162,136 A * 12/2000 Aoyama ..... 473/383
6,277,038 B1 8/2001 Sullivan
6,290,615 B1 9/2001 Ogg
7,041,013 B2 * 5/2006 Ohama et al. ..... 473/384

* cited by examiner

*Primary Examiner*—Raeann Gorden
(74) *Attorney, Agent, or Firm*—Oliff & Berridge, PLC

(57) ABSTRACT

A golf ball having a predetermined radius, and a spherical outer surface with a multiplicity of dimples formed therein. A protrusion is formed in each of the dimples which are located in hit portions having a diameter of 5–15 mm, or alternatively, is formed in each of all the dimples. The protrusion has a distal end whose radial distance from the center of the golf ball is equal to the predetermined radius of the golf ball. The protrusion has a partition wall which divides a space in each dimple into a plurality of segmental spaces. The protrusion may have two partition walls which are perpendicular to each other and intersect at right angles for dividing a space in each of the dimples into four segmental spaces.

5 Claims, 10 Drawing Sheets

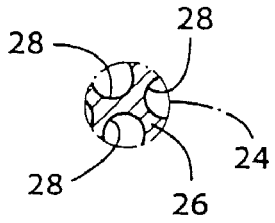
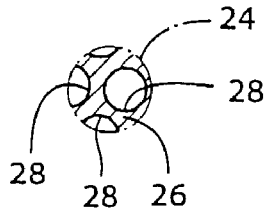
FIG. 3(a) FIG. 3(b)
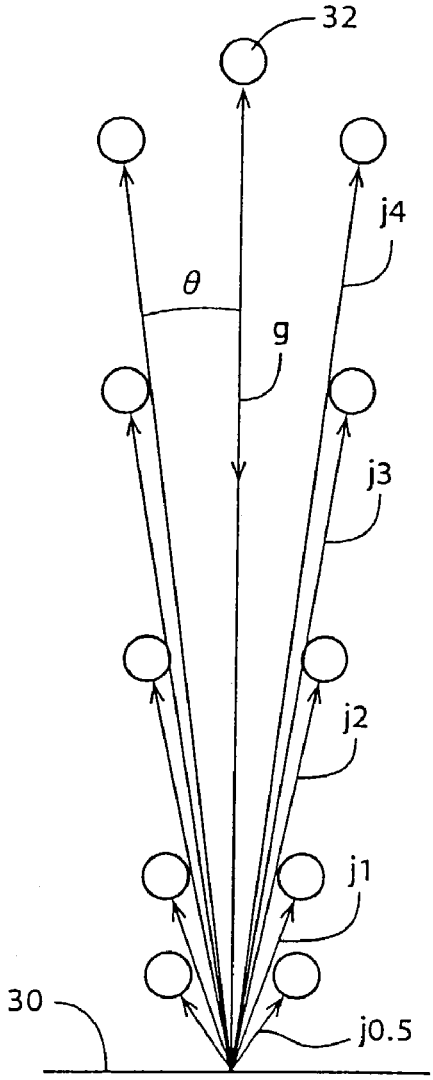
FIG. 4

GOLF BALL WITH IMPROVED DIRECTIONAL STABILITY IN PUTTING STROKE

This is a Continuation-In-Part application of application Ser. No. 09/778,813, filed on Feb. 8, 2001 now abandoned.

BACKGROUND OF THE INVENTION

1. Field of the Invention

The present invention relates in general to improvements in a golf ball.

2. Discussion of the Related Art

There is known a golf ball consisting principally of, for example, a spherical body having a certain degree of elasticity, and a rubber-made cover covering an outer surface of the spherical body. The spherical body includes a rubber-made, spherical core which is wound with a rubber thread or other fiber. In an outer surface of the rubber-made cover, there are formed a multiplicity of shallow recesses or dimples each having, in general, a substantially circular shape whose diameter is about 1–3 mm, such that the dimples are distributed substantially evenly over the entire outer surface of the cover. The dimples assist the ball, when hit by a club, to fly high and straight in a golf course. That is, the dimples serve to increase the flight distance and the directional stability of the ball.

In the following description, the term "golf course" is interpreted to mean a golf course area excluding a putting green, unless otherwise specified.

In general, a putter is used as a club for putting in a green of the golf course. It is considered important, in a putting play, to set a hitting surface of the putter to be perpendicular to a desired direction in which the ball is intended to run, namely, to be perpendicular to a line to a target hole which line is determined on the basis of various factors such as influences of grass grain upon the ball, and to then swing the putter to stroke the ball parallel to the determined line. However, even if the putter is swung or stroked straight and parallel to the determined line, the ball does not necessarily run along the line, resulting in difficulty of making the ball run in the desired direction with a sufficient stability. Such a difficulty of controlling the direction of the ball tends to be increased, particularly, in a putting stroke with what is called a "soft touch", in which the ball is hit with a comparatively small hitting force.

Various experiments conducted by the present inventors for studying about the above-described problem revealed that dimples formed in the outer surface of the ball make it difficult to putt the ball in the desired direction with a sufficient stability. A pressed area of the outer surface of the ball, which is pressed by a face of a club as the ball is hit by the club, is elastically deformed to become substantially flat, and a reaction force is then generated as a result of the elastic deformation in the pressed area. This reaction force which restores the pressed area to its original shape, i.e., a part-spherical face serves as a thrust force for thrusting or moving the ball. In this instance, strictly speaking, the pressed area does not become entirely flat due to the presence of the dimples, and some protrusions and recesses remain in the pressed area. The thrust force is generated by a comparatively protruding area of the pressed area which is located between the dimples, namely, by a contact area of the pressed area which is actually brought in contact with the club face. The thrust force is not generated by the other area of the pressed area which is not actually brought in contact with the club face.

In a putting stroke, in which the ball is generally hit with a comparatively small hitting force, the above-described pressed area generally has a diameter so small as about 5–15 mm, for example, about 10 mm, so that the dimples each having a diameter of about 1–3 mm are not necessarily distributed evenly within such a small pressed area, unless the dimples and the pressed area are intentionally positioned relative to each other. The uneven distribution of the dimples within the pressed area means that the center of balance of the contact area of the pressed area which is actually brought into contact with the club face, i.e., the center of distribution of the reaction force applied to the club face from the ball deviates from the center of the circular-shaped pressed area, whereby the reaction force does not act in a direction parallel to a direction in which the club is swung or stroked, resulting in difficulty of making the ball run in the desired direction with a sufficient stability.

SUMMARY OF THE INVENTION

It is therefore an object of the present invention to provide a golf ball which is capable of minimizing the deviation of the center of balance of the contact area from the center of the pressed area, so that the ball is made to run in a desired direction with an improved stability.

The above object may be achieved according to a first preferred form of the present invention, which provides a golf ball having a predetermined radius, and a spherical outer surface with a multiplicity of dimples formed therein, wherein the spherical outer surface has at least one hit portion which has a diameter of 5–15 mm and within which the dimples are absent.

When the golf ball constructed according to the first preferred form of the invention is pressed at any one of the above-described at least one hit portion by a face of a club, the hit portion becomes substantially flat with substantially no protrusions and recesses therein, owing to the absence of the dimples within the hit portion, and is brought into contact in its entirety with the club face, so that the center of distribution of the reaction force of the ball substantially coincides with the center of the pressed area. In other words, the hit portion, i.e., the undimpled portion having the diameter of at least 5 mm provides a flat portion having a diameter of at least 5 mm, within the pressed area which has a diameter of about 5–15 mm in a putting stroke, whereby a sufficiently increased part of the pressed area is brought in contact with the club face. That is, a sufficiently increased contact area actually brought in contact with the club face is provided within the pressed area so that the center of balance of the contact area substantially coincides with the center of the pressed area.

Such a substantial coincidence of the center of distribution of the reaction force and the center of the pressed area is obtained even where the diameter of the pressed area is made larger than the diameter of the hit portion, namely where some part of the pressed area is not brought in contact with the club face. Therefore, the reaction force acts in a direction substantially parallel to a direction in which the club is swung or stroked, irrespective of the amount of the hitting force. It is noted that the diameter of the hit portion may be interpreted to mean a diameter as seen in projection by parallel rays emitted in a direction parallel to a straight line connecting the center of the hit portion and the center of the ball.

As described above, the dimples serve to advantageously increase the flight distance of the ball and improve the directional stability of the ball. These advantageous effects provided by the dimples are not so influenced by the undimpled hit portion. That is, the influences of the undimpled hit portion upon the flight distance and the directional stability of the ball are negligibly small, since the maximum diameter of the undimpled hit portion is as small as about 15 mm.

It is not possible to control the ball, which has been hit, to be stopped such that the undimpled hit portion of the ball is positioned in a desired position relative to a target hole. However, it is possible to adjust the position of the undimpled hit portion of the ball relative to the target hole when the ball is replaced at a stopped position on a putting green, on which the ball is allowed to be lifted or picked up after the stopped position is marked by placing a ball-marker (e.g., a small coin or other similar object) immediately behind the ball. Thus, the ball can be put on the putting green such that the center of the hit portion is positioned on a predetermined line to the target hole and such that the center of the hit portion is remoter from the target hole than the center of the ball, so that the undimpled hit portion serves as the pressed area to be pressed by the club face in a putting stroke.

It might be possible to putt a conventional ball (which does not have a particular portion equivalent to the hit portion) in a desired direction, by pressing a suitable point of the outer surface of the conventional ball by a putter face such that the dimples are distributed evenly in the entirety of the pressed area, namely, such that the center of balance of the contact area substantially coincides with the center of the pressed area. However, the diameter of the pressed area in a putting stroke is so small that the distribution of the dimples or the center of balance of the contact area is easily changed or displaced even with a small amount of deviation of an actually pressed point from the above-described suitable point. Thus, for making the conventional ball run in a desired direction, it is necessary to accurately locate the suitable point and then press the ball precisely at the suitable point, which are extremely difficult to be done by a golf player during his putting play.

According to one advantageous arrangement of the first preferred form of the invention, the above-described at least one hit portion consists of a plurality of hit portions which are positioned relative to each other such that a center of balance of the plurality of hit portions coincides with the center of the golf ball. This balanced arrangement of the hit portions permits the golf ball to enjoy an aerodynamic uniformity, during its flight in a golf course, as a conventional ball which does not have the undimpled hit portions, thereby minimizing a negative aerodynamic effect and preventing a reduction of the flight distance.

The above object may be also achieved according to a second preferred form of the present invention, which provides a golf ball having a predetermined radius, and a spherical outer surface with a multiplicity of dimples formed therein, wherein the spherical outer surface has at least one hit portion which has a diameter of 5–15 mm and within which the dimples are absent except a single one of the dimples that is located at a central part of the hit portion.

In the hit portion of the golf ball of the second preferred form of the invention, the single dimple is located at the central part of the hit portion, and an annular part of the hit portion surrounding the central part constitutes a part of the spherical outer surface. When the golf ball of the second preferred form of the invention is pressed at the hit portion by a club face, the annular part of the hit portion becomes substantially flat with substantially no protrusions and recesses therein, and is brought into contact with the club face, so that the center of distribution of the reaction force of the ball substantially coincides with the center of the pressed area. In other words, the hit portion, i.e., the single-dimple portion having the diameter of at least 5 mm provides an annular-shaped flat portion having a diameter of at least 5 mm, in the pressed area which has a diameter of about 5–15 mm in a putting stroke, whereby a sufficiently increased contact area actually brought in contact with the club face is provided in the pressed area so that the center of balance of the contact area substantially coincides with the center of the pressed area.

Such a substantial coincidence of the center of distribution of the reaction force and the center of the pressed area is obtained, even where the center of the pressed area does not exactly coincide with the center of the hit portion, or even where the diameter of the pressed area is made larger than the diameter of the hit portion, namely where some part of the pressed area is not brought in contact with the club face. Therefore, the reaction force acts in a direction substantially parallel to a direction in which the club is swung or stroked, so that the ball is made to run in a desired direction substantially equal to the direction in which the club is stroked.

The hit portion of the golf ball of the second preferred form of the invention has the single dimple located at the center part, while the hit portion of the golf ball of the first preferred form does not have any one of the dimples. This means that the golf ball of the second preferred form has a smaller area in which the dimples are absent, than that of the golf ball of the first preferred form, thereby further minimizing a negative aerodynamic effect. Further, the golf ball of the second preferred form is advantageous over the golf ball of the first preferred form, for minimizing a negative sensuous effect. For example, the smaller undimpled area provides a better appearance of the ball. The provision of the single dimple in the hit portion provides a better hit sound in a putting stroke, since the ball is hit at the central part of the hit portion at which the single dimple is located.

The above object may be also achieved according to a third preferred form of the present invention, which provides a golf ball having a predetermined radius, and a spherical outer surface with a multiplicity of dimples formed therein, wherein the spherical outer surface has at least one hit portion which has a diameter of 5–15 mm and within which the dimples are absent and a plurality of grooves are formed to be distributed evenly in the entirety of the hit portion, each of the grooves having a predetermined shape and a width which is smaller than a diameter of each of the dimples.

In the hit portion of the golf ball of the third preferred form of the invention, the dimples are absent while the grooves each having the width smaller than the diameter of each dimple are formed to be distributed evenly in the entirety of the hit portion. Where the golf ball is pressed at this hit portion by a club face, the deviation of the center of balance of the contact area from the center of the pressed area tends to be reduced more than where the golf ball is pressed at the other portion of the spherical outer surface in which the dimples each having the diameter larger than the width of each groove are formed. Thus, by hitting the ball at the hit portion in a putting stroke, it is possible to make the center of the pressed area substantially coincide with the center of distribution of the reaction force, so that the reaction force acts in a direction substantially parallel to a direction in which the club is swung or stroked, whereby the ball is made to run in a desired direction substantially equal to the direction in which the club is stroked.

In the golf ball of the third preferred form of the invention, a negative aerodynamic effect is more reduced, owing to the provision of the grooves or recesses in the hit portion, than in the golf ball of the first preferred form having the undimpled hit portion in which any one of the dimples or recesses is not formed.

According to a first advantageous arrangement of the third preferred form of the invention, the grooves are arranged in a lattice and intersect each other, so that the grooves formed in the hit portion are symmetrical with each other. The lattice or symmetrical arrangement of the grooves further reduces the deviation of the center of distribution of the reaction force from the center of the pressed area, where the center of the pressed area is deviated from the center of the hit portion, i.e., where the golf ball is not hit at the center of the hit portion. Thus, the arrangement of this first advantageous arrangement is effective to further improve the directional stability of the ball in a putting stroke.

According to a second advantageous arrangement of the third preferred form of the invention, the grooves are annular grooves having respective diameters different from each other and respective centers lying at a center of the hit portion, so that the grooves are held in a concentric relationship with each other. This concentric arrangement of the grooves also further reduces the deviation of the center of distribution of the reaction force from the center of the pressed area, where the center of the pressed area is deviated from the center of the hit portion. Thus, the arrangement of this second advantageous arrangement is also effective to further improve the directional stability of the ball in a putting stroke.

According to a third advantageous arrangement of the third preferred form of the invention, the grooves are arranged to be parallel to each other. This parallel arrangement of the grooves also further reduces the deviation of the center of distribution of the reaction force from the center of the pressed area, where the center of the pressed area is deviated from the center of the hit portion. Thus, the arrangement of this third advantageous arrangement is also effective to further improve the directional stability of the ball in a putting stroke. Further, the arrangement of this third advantageous arrangement provides another advantage of minimizing undesirable displacement of the center of balance of the contact area relative to the center of the pressed area, by setting the ball on a putting green such that the parallel grooves are brought in parallel to the vertical or horizontal direction in a preparation for a putting stoke, even if the center of the pressed area is deviated from the center of the hit portion in the putting stroke.

The above object may be also achieved according to a fourth preferred form of the present invention, which provides a golf ball having a predetermined radius, and a spherical outer surface with a multiplicity of dimples formed therein, wherein the spherical outer surface has at least one hit portion which has a diameter of 5–15 mm and within which a protrusion is formed in each of the dimples, the protrusion having a distal end whose radial distance from the center of the golf ball is equal to the predetermined radius of the golf ball.

In the hit portion of the golf ball of the fourth preferred form of the invention, the protrusions, each having the distal end whose radial distance from the center of the golf ball is equal to the predetermined radius of the golf ball, are formed in the respective dimples. Where the golf ball is pressed at this hit portion by a club face, the protrusion constituting a part of area inside each dimple, as well as an area surrounding each dimple, is brought in contact with the club face, thereby providing a sufficiently increased contact area within the pressed area and accordingly minimizing the deviation of the center of balance of the contact area from the center of the pressed area, so that the center of balance of the contact area substantially coincides with the center of the pressed area. Thus, by hitting the ball at the hit portion in a putting stroke, it is possible to make the center of the pressed area substantially coincide with the center of distribution of the reaction force, so that the reaction force acts in a direction substantially parallel to a direction in which the club is swung or stroked, whereby the ball is made to run in a desired direction substantially equal to the direction in which the club is stroked.

In the golf ball of the fourth preferred form of the invention, a negative aerodynamic effect and a negative sensuous effect such as deterioration of the appearance are more reduced, owing to the provision of the dimples in the hit portion as well as in the other portions of the spherical outer surface of the golf ball, than in the golf ball of the first preferred form having the undimpled hit portion in which any one of the dimples is not provided.

According to a first advantageous arrangement of the fourth preferred form of the invention, the protrusion is positioned relative to each of the dimples such that the protrusion has a concentric relation with each of the dimples.

According to a second advantageous arrangement of the fourth preferred form of the invention, the protrusion has a partition wall which divides a space in each of the dimples into a plurality of segmental spaces. The partition wall may consist of two partition walls which are perpendicular to each other and intersect at right angles for dividing a space in each of the dimples into four segmental spaces.

In either of the first and second arrangements of the fourth preferred form, a sufficiently increased contact area actually brought in contact with a club face is provided in the pressed area, and the directional stability of the ball in a putting stroke is accordingly improved.

The above object may be also achieved according to a fifth preferred form of the present invention, which provides a golf ball having a predetermined radius, and a spherical outer surface with a multiplicity of dimples formed therein, wherein a protrusion is formed in each of the dimples, the protrusion having a distal end whose radial distance from the center of the golf ball is equal to the predetermined radius of the golf ball, and wherein the protrusion has a partition wall which divides a space in each of the dimples into a plurality of segmental spaces.

According to a first advantageous arrangement of the fifth preferred form of the invention, the protrusion has two partition walls which are perpendicular to each other and intersect at right angles for dividing a space in each of the dimples into four segmental spaces.

According to a second advantageous arrangement of the fifth preferred form of the invention, a spacing interval between adjacent ones of the dimples is smaller than 2 mm. It is noted that the term "spacing interval" may be interpreted to correspond to a distance between the closest points of the edges of the adjacent dimples.

In the golf ball of the fifth preferred form of the invention, the protrusion is formed in each of all the dimples so that the protrusion is substantially evenly distributed over the entirety of the spherical outer surface of the ball. Accordingly, any part of the spherical outer surface of the ball can serve as a hit portion that should be brought into contact with a club face in a putting stroke. In other words, irrespective of which part of the spherical outer surface of the ball is brought into contact with the club face, the protrusion constituting a part of area inside each dimple, as well as an area surrounding each dimple, is brought into contact with the club face, thereby providing a sufficiently increased contact area within the pressed area and accordingly minimizing the deviation of the center of balance of the contact area from the center of the pressed area. This means that the golf ball of this fifth preferred form does not require the above-described positional adjustment of a particular portion of the spherical outer surface of the ball relative to the target hole. The elimination of the necessity of the positional adjustment is advantageous, particularly, where a putting stroke has to be done in a non-green area or an area close to the green such as a fringe in which the ball is not allowed to be lifted or picked up, namely, where a putting stroke has to be done without the above-described positional adjustment.

The golf ball of the fifth preferred form of the invention has another technical advantage owing to the even distribution of the protrusions over the entirety of the spherical outer surface of the golf ball. That is, the even distribution of the protrusions as well as the dimples provides a high degree of rectilinear movement of the ball on a putting green. As discussed above, for making the ball run in a player's desired direction, i.e., along a line directed to the target hole, the reaction force generated upon contact of the ball with the club face has to act in a direction substantially parallel to a direction in which the club is swung or stroked. However, strictly speaking, for assuring the running of the ball in the directed line, it is necessary to take account of, in addition to the reaction force upon the contact of the ball with the club face, a resistant force applied from a surface of the putting green to the ball during running of the ball. If such a resistant force applied from the green surface acts on the running ball asymmetrically with respect to the directed line, the ball would deviate from the directed line, turning to right or left. It is considered that the resistant force is influenced by an arrangement of the protrusions and recesses on the spherical outer surface of the golf ball. That is, a tendency of the asymmetrical application of the resistant force can be made smaller where the protrusions and recesses are distributed evenly on the spherical outer surface of the ball, than where the protrusions and recesses are not distributed evenly on the spherical outer surface of the ball.

BRIEF DESCRIPTION OF THE DRAWINGS

The above object, features and advantages of the present invention will be better understood by reading the following detailed description of presently preferred embodiments of the invention, when considered in connection with the accompanying drawings, in which:

FIG. 1(*b*) is a view for explaining the arrangement of undimpled portions provided on the surface of the golf ball of FIG. 1(*a*);

FIG. 2(*b*) is a view taken in a direction of arrow b of FIG. 2(*a*);

FIGS. 3(*a*) and (*b*) are views illustrating examples of a contact area at which a conventional golf ball is brought in contact with a putter face;

FIG. 4 is a view for explaining an experiment conducted for confirming influences of dimples of a conventional ball upon a rebounding direction of the conventional ball;

FIG. 12(*b*) is an enlarged view showing a part of the surface of the ball of FIG. 12(*a*);

FIG. 12(*c*) is a view showing a cross section of the above-described part of the surface of the ball of FIG. 12(*a*);

FIG. 13(*b*) is an enlarged view showing a part of the surface of the ball of FIG. 13(*a*);

FIG. 14(*b*) is an enlarged view showing a part of the surface of the ball of FIG. 14(*a*).

DETAILED DESCRIPTION OF THE PREFERRED EMBODIMENTS

Figure 1A:
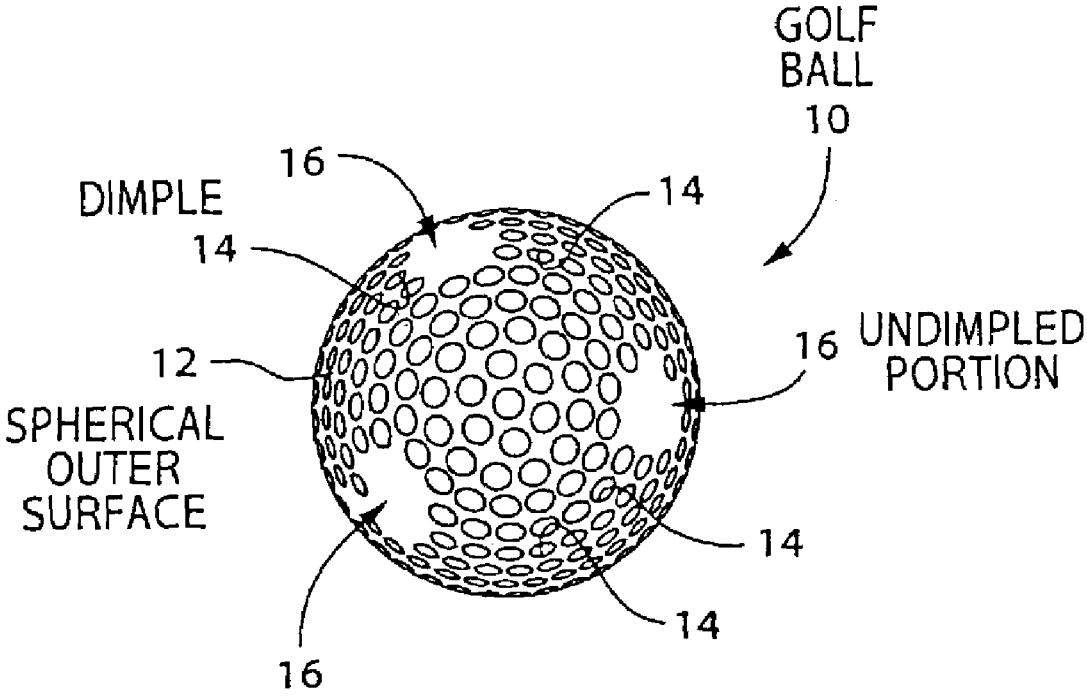
FIG. 1(*a*) is a view showing a golf ball according to a first embodiment of this invention.
Figure 1B:
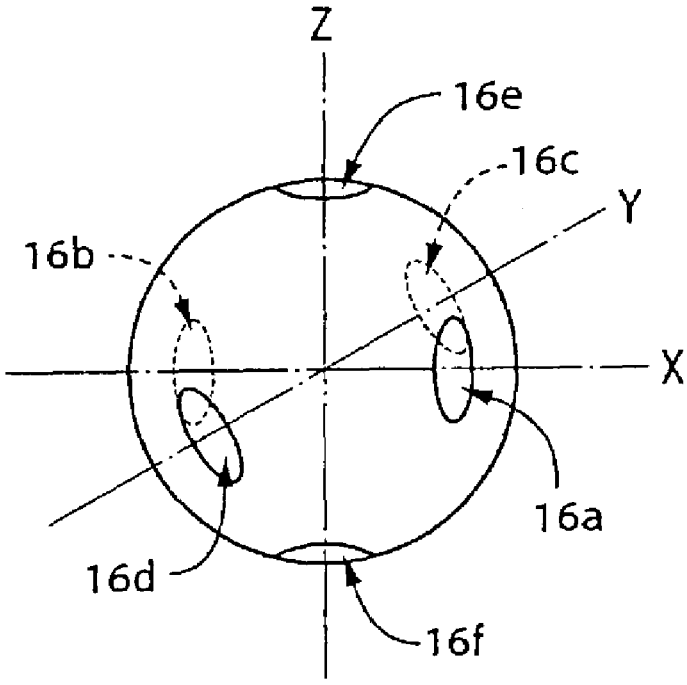

Referring first to FIGS. 1(*a*) and (*b*), there is shown a golf ball 10 of a first embodiment of this invention which is constructed in accordance with golf international standards. The golf ball 10 has a predetermined radius, and is made of a rubber material similar to that used in conventional golf balls to have a certain degree of elasticity. The golf ball 10 has, in its spherical outer surface 12, a multiplicity of shallow depressions or dimples 14 formed to be arranged according to a predetermined pattern. Each of the dimples 14 has a substantially circular shape whose diameter is about 1–3 mm.

In the major portion of the spherical outer surface 12 of the ball 10, the spacing interval between adjacent ones of the dimples 14 is not larger than, for example, about 1–2 mm. However, in local portions of the spherical outer surface 12, the spacing interval between the adjacent dimples 14 is increased to, for example, about 10 mm. That is, the spherical outer surface 12 has, in its local portions, substantially circular-shaped undimpled portions 16 in each of which the dimples 14 are not formed. Each undimpled portion 16 is dimensioned such that a circle having a diameter of about 10 mm is inscribed in the undimpled portion 16. In the golf ball 10 of the present embodiment, the spherical outer surface 12 has six undimpled portions 16 which are symmetrically arranged as shown in FIG. 1(*b*). Specifically described, the undimpled portions 16*a*, 16*b* are arranged so as to lie on X-axis, which is one of three axes perpendicular to each other and meet at the center of the ball 10, so as to be symmetrical with each other with respect to the center of the ball 10. The undimpled portions 16*c*, 16*d* are arranged to lie on Y-axis to be symmetrical with each other with respect to the center of the ball 10. The undimpled portions 16*e*, 16*f* are arranged to lie on Z-axis to be symmetrical with each other with respect to the center of the ball 10.

It is noted that each of the undimpled portions 16, which is represented by a circle in FIG. 1(*b*), is defined by profiles of ones of the dimples 14 surrounding the undimpled portion 16. Thus, each undimpled portion 16 has a profile consisting of a succession of recesses and protrusions arranged alternately in the circumferential direction of the undimpled portion 16, wherein the recesses and protrusions are provided by the profiles of those ones of the dimples 14 surrounding the undimpled portion 16. It is also noted that each undimpled portion 16 has a part-spherical outer surface which constitutes a part of the spherical outer surface having a radius R. Namely, the undimpled portions 16 cooperate with the above-described major portion to constitute the spherical outer surface of the ball 10.

Figure 2A:
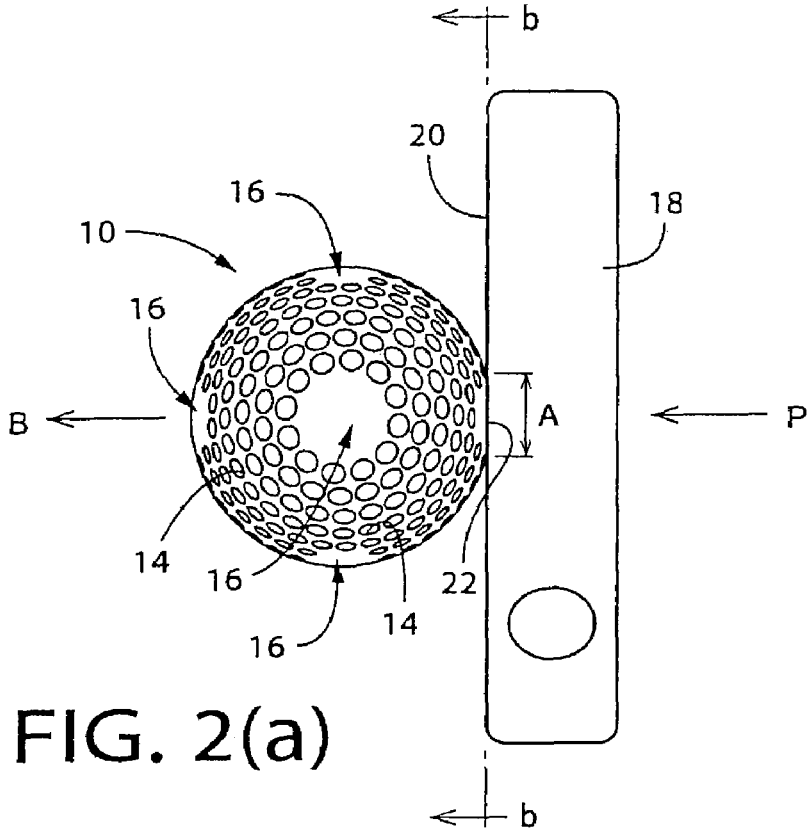
FIG. 2(*a*) is an upper plan view showing the golf ball of FIG. 1(*a*) at an impact moment when the golf ball is hit by a putter.
Figure 2B:
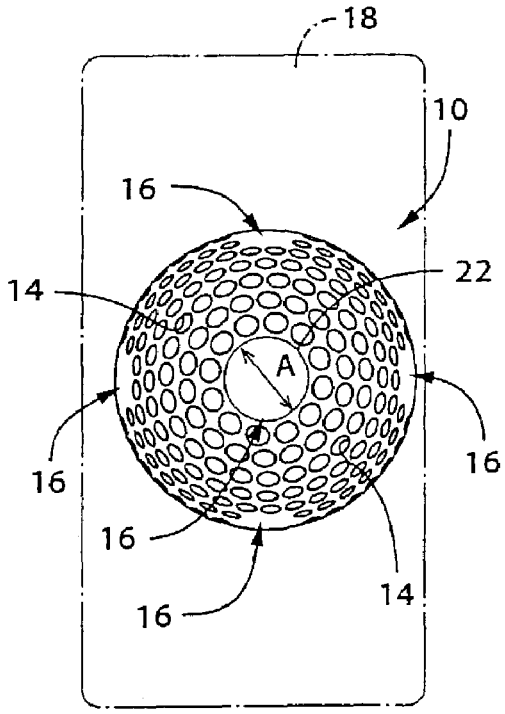

FIG. 2(*a*) is an upper plan view showing the ball 10 at an impact moment when the ball 10 is hit at a pressed area 22 of the spherical outer surface 12, by a putter face 20 of a putter head 18 for putting the ball 10 on a green. At the impact moment, the pressed area 22 is deformed to become a substantially flat face conforming to the putter face 20, due to a friction force acting between the ball 10 and a grass of the green on which the ball 10 lies, and also a pressing force applied to the ball 10 from the putter face 20. The pressed area 22 has a substantially circular shape (whose diameter A is about 5–15 mm), as shown in FIG. 2(*b*) which is a view taken in a direction of arrow b of FIG. 2(*a*). The diameter of the circular-shaped pressed area 22 varies depending upon amount of a hitting force with which the ball 10 is hit, and tends to be reduced with a reduction of the amount of the hitting force. The diameter of the pressed area 22 is about 5–15 mm in a putting stroke in which the ball is generally hit with a comparatively small hitting force. It is appreciated that the entirety of the pressed area 22 is located within one of the undimpled portions 16 in FIG. 2(*b*). That is, in a preparation for putting the ball 10, the ball 10 is put on the green while taking account of a direction of stroke of the putter head 18, such that one of the undimpled portions 16 serves as the pressed area 22. In the present embodiment, the undimpled portions 16 correspond to hit portions.

Since the ball 10 is brought into contact in almost the entirety of the circular-shaped pressed area 22 with the putter face 20 at the above-described impact moment, the center of balance of a contact area actually brought in contact with the putter face 20 substantially coincides with the center of the pressed area 22. Described specifically, when the ball 10 is pressed at the undimpled portion 16, which has the diameter of about 10 mm and within which the dimples 14 are not formed, by the putter face 20, the pressed area 22 becomes substantially flat with substantially no protrusions and recesses therein, so that the center of distribution of the reaction force applied to the putter face 20 from the ball 10 substantially coincides with the center of the circular-shaped pressed area 22 which is brought in contact with the putter face 20 so as to become substantially flat. Accordingly, a reaction force, which serves as a thrust force for thrusting or moving the ball 10, is generated based on a restoring force of the ball 10 for restoring the pressed area 22 to its original shape, i.e., a part-spherical shape, and acts in a direction which is substantially parallel to a direction P in which the putter head 18 is swung or stroked, on the assumption that the putter face 20 is kept in perpendicular to the direction P during the stroke of the putter head 18. The ball 10 runs based on the thrust force in a direction B which is substantially parallel to the direction P of the stroke of the putter head 18, thereby making it possible to putt the ball 10 in a desired direction with an improved stability.

On the other hand, when a conventional golf ball, in which the dimples are formed to be arranged evenly in its entire spherical outer surface, is hit by the putter face 20, the conventional ball is brought in contact with the putter face 20, as illustrated in FIGS. 3(*a*) or (*b*). In FIGS. 3(*a*) and (*b*), a circle 24 defined by one-dot chain line represents a pressed area at which the conventional ball is hit by the putter face 20, an area 26 indicated by oblique lines represents a contact area of the pressed area 24 which area is actually brought in contact with the putter face 20, and areas 28 indicated by voids or blanks represent the dimples formed in the spherical outer surface. There is a case where the center of the pressed area 24 does not coincide with the center of balance of the contact area 26, as shown in FIGS. 3(*a*) or (*b*). In such a case, the center of the pressed area 24 does not coincide with the center of distribution of the reaction force applied to the putter face 20, so that the running direction of the ball does not coincide with the stroke direction of the putter head 18. The running direction is undesirably variable depending upon how the ball is brought in contact with the putter face 20, thereby making it difficult to putt the ball in a desired direction with a high stability.

As described above, the undimpled portions 16 are arranged to be symmetrical with each other with respect to the center of the golf ball 10, so that a center of balance of the undimpled portions 16 coincides with the center of the ball 10. This arrangement of the undimpled portions 16 permits the ball 10 to enjoy an aerodynamic uniformity, during its flight in a golf course, as the conventional ball which does not have the undimpled portions 16. In other words, the symmetrical or balanced arrangement of the undimpled portions 16 is effective to minimize a negative aerodynamic effect due to the absence of the dimples 14 in each undimpled portion 16, thereby avoiding a reduction of the flight distance.

FIG. 4 shows the result of an experiment conducted by using a conventional golf ball 32 in which the dimples 28 are formed evenly in the entire spherical outer surface, for confirming influences of the dimples 28 over a direction in which the ball 32 advances, runs or flies. In the experiment, the conventional ball 32 was made to freely fall from various height levels towards a flat horizontal surface 30 having a hardness and other material characteristics similar to those of the putter face 20, and variations in an inclination of a rebounding direction j of the ball 32 with respect to a falling locus g of the ball 32 are measured. The j4, j3, j2, j1 and j0.5 represent the respective maximum inclinations of the rebounding direction j with respect to the falling locus g (which are described to be symmetrical with respect to the falling locus g), when the ball 32 was made to fall from the respective heights of 4 m, 3 m, 2 m, 1 m and 0.5 m. In other words, the j4, j3, j2, j1 and j0.5 represent the respective variations in the inclination of the rebounding direction j with respect to the falling locus g when the ball 32 was made to fall from the respective heights. It is appreciated from FIG. 4 that the maximum inclination, i.e., the variation in the inclination was increased with a reduction in the height from which the ball 32 was made to fall.

Figure 5:
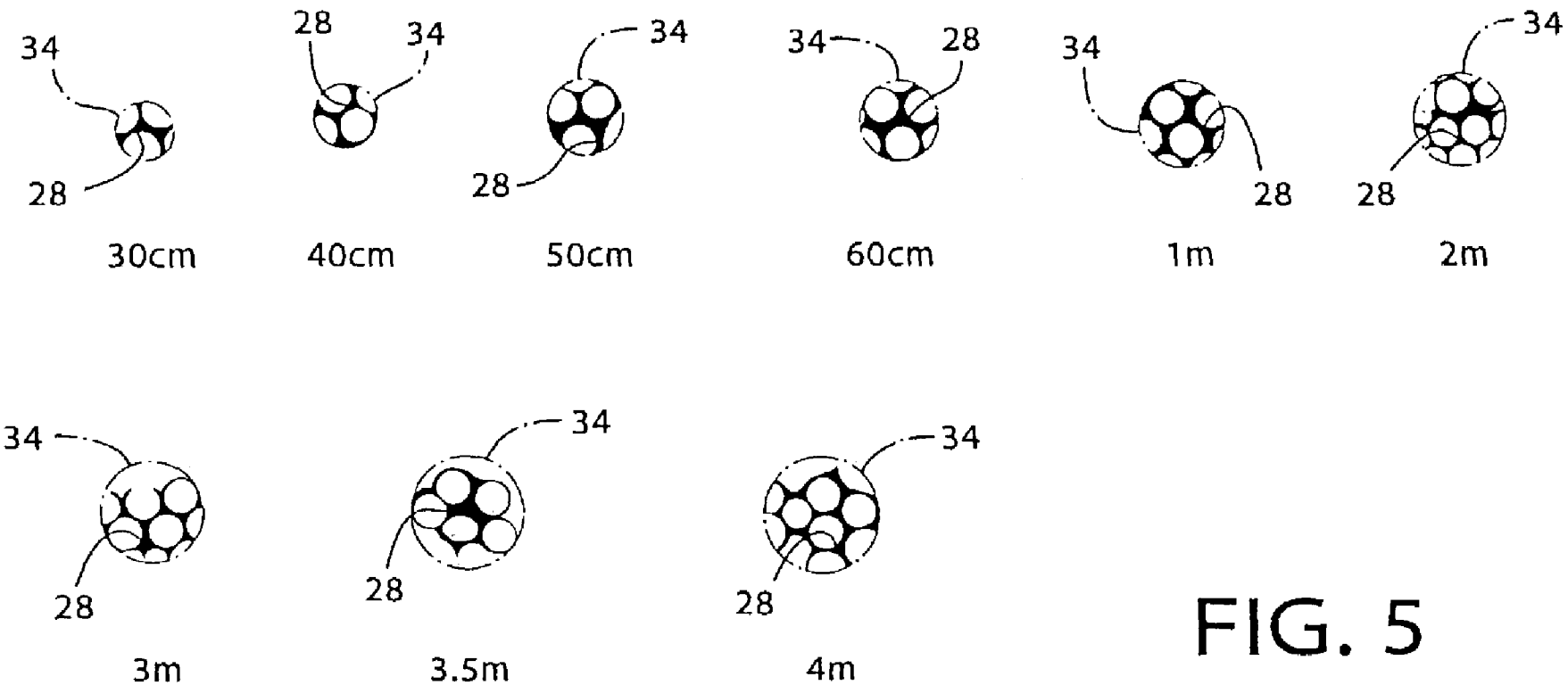
FIG. 5 is a view illustrating a contact area of the conventional ball which was actually brought in contact with a flat horizontal surface when the ball was dropped from each of various height levels in the experiment of FIG. 4.

FIG. 5 illustrates a contact area of the spherical outer surface of the ball 32 which area was actually brought in contact with the flat horizontal surface 30 when the ball 32 was made to fall from each of the various height levels in the above-described experiment. Each illustration of FIG. 5 was obtained by applying an ink to the entire outer surface of the ball 32 except the dimples 28 before the ball 32 was made to fall. It is considered that the actual contact area of the spherical outer surface of the ball 32 is not necessarily exactly represented by the corresponding illustration, since the ink was not necessarily applied evenly to the entire spherical outer surface of the ball 32.

In FIG. 5, a circle 34 defined by one-dot chain line represents a pressed area of the spherical outer surface of the ball 32 which portion was pressed by the flat horizontal surface 30 to become flat, while an inked area within the circular-shaped pressed area 34 represents a contact area which was actually brought in contact with the flat horizontal surface 30. As is apparent from FIG. 5, the dimples 28 were not necessarily distributed evenly in the entirety of the pressed area 34. This means that the center of balance of the contact area was likely to be deviated from the center of the pressed area 34. When the ball 32 was made to fall from the comparatively small height, e.g., from a height not larger than 3 m, the circular-shaped pressed area 34 was so small that the amount of the deviation of the center of balance of the contact area from the center of the pressed area 34 tended to be increased. However, the deviation amount tended to be reduced with an increase in the height from which the ball 32 was made to fall, namely, with an increase in the number of the dimples 28 included in the pressed area 34. The deviation amount was reduced to almost zero, when the ball 32 was made to fall from the height of 4 m.

The above-described inclination of the rebounding direction j with respect to the falling locus g relates to this "deviation" which is caused by the presence of the dimples 28 in the spherical outer surface of the ball 32. The maximum inclination was increased with the increase in the deviation as a result of the reduction of the pressed area 34 when the ball 32 was made to fall from the comparatively small height. The maximum inclination was reduced with the reduction in the deviation as a result of the increase of the pressed area 34 when the ball 32 was made to fall from the comparatively large height.

This means that the influences of the dimples 28 upon the direction in which the ball 32 advances are reduced with an increase in the hitting force so that the advance direction of the ball 32 is somewhat stabilized. However, the advance direction of the ball 32 is considerably influenced by the dimples 28 when the ball 32 is hit with a small hitting force, e.g., in a "soft touch" putting stroke so that the advance direction of the ball 32 is not stabilized. In this view, it is possible to improve the directional stability even in a soft touch putting stroke, by providing the undimpled portions 16 in the spherical outer surface of the ball and thereby eliminating or minimizing the influences of the dimples, as in the golf ball 10 of the present embodiment.

Referring next to FIGS. 6–14, there will be described some other golf balls constructed according to second, third, fourth, fifth, sixth, seventh, eighth and ninth embodiments of this invention. In these embodiments, the same reference numerals as used in the first embodiment of FIGS. 1(*a*) and (*b*) will be used to identify the elements which are the same as or similar to those in the first embodiment. No redundant description of these elements will be provided, in the interest of simplification of the description.

Figure 6:
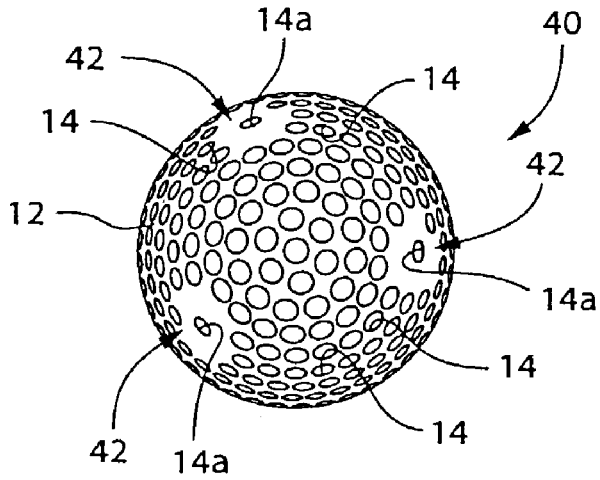
FIG. 6 is a view showing a golf ball according to a second embodiment of this invention.
Figure 7:
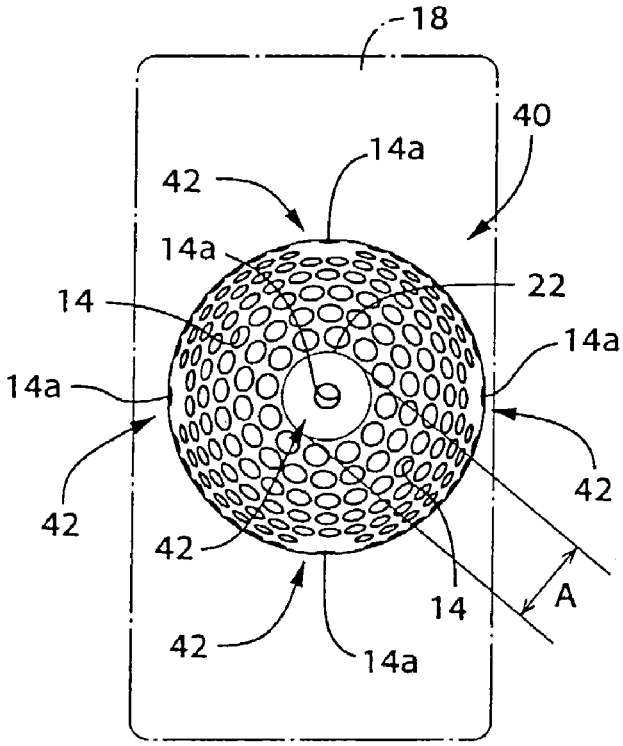
FIG. 7 is a view corresponding to that of FIG. 2(*b*) and taken from the side of a pressed area, for showing the ball of FIG. 6 at an impact moment when the ball is hit at the pressed area.

FIGS. 6 and 7 show a golf ball 40 of the second embodiment which has single-dimple portions 42 in place of the undimpled portions 16. That is, the spherical outer surface 12 of the ball 40 has six single-dimple portions 42 which are arranged to be symmetrical with each other with respect to the center of the golf ball 40, in addition to the major portion in which the spacing interval between adjacent ones of the dimples 14 is not larger than about 1–2 mm. In each of the six single-dimple portion 42 (three of which are invisible in FIG. 6), the dimples 14 are absent except a single one 14*a* of the dimples 14 which is located at a central part of each of the single-dimple portions 42. Each single-dimple portion 42 is dimensioned such that a circle having a diameter of about 10 mm is inscribed in the single-dimple portion 42. The dimple 14*a* located at the central part of the single-dimple portion 42 has a diameter of about 1–3 mm and the same shape as the other dimples 14, and has a concentric relationship with the inscribed circle. Thus, the dimple. 14*a* has a size sufficiently smaller than that of each single-dimple portion 42. An annular part of each single-dimple portion 42 which surrounds the dimple 14*a* and which is located between the dimple 14*a* and those ones of the dimples 14 surrounding the single-dimple portion 42 has a part-spherical outer surface which constitutes a part of the spherical outer surface 12 having a radius R. Namely, the annular parts of the respective single-dimple portions 42 cooperate with the major portion to constitute the spherical outer surface 12 of the ball 40. Therefore, the single-dimple portion 42 is substantially identical with the undimpled portion 16 except for the provision of the single dimple 14*a* at the central part of portion.

FIG. 7 is a view corresponding to that of FIG. 2(*b*) and taken from the side of the pressed area 22, for showing the ball 40 at an impact moment in a putting stroke. At the impact moment, the pressed area 22 is deformed to become a flat face conforming to the putter face 20 and having a substantially circular shape whose diameter A is about 5–15 mm, as in the case of the ball 10 of the first embodiment. FIG. 7 shows a case where the pressed area 22 is brought in a concentric relationship with the substantially circular-shaped single-dimple portion 42, namely, with the single dimple 14*a* located at the central part of the single-dimple portion 42, and where the entirety of the pressed area 22 is located within the single-dimple portion 42. In the present embodiment, the single-dimple portions 42 correspond to hit portions. In a preparation for putting the ball 40, the ball 40 is put on the green such that one of the single-dimple portions 42 serves as the pressed area 22.

Since the ball 40 is brought into contact in almost the entirety of the circular-shaped pressed area 22 with the putter face 20 at the above-described impact moment, the center of balance of a contact area actually brought in contact with the putter face 20 substantially coincides with the center of the pressed area 22. Described specifically, when the ball 40 is pressed at the single-dimple portion 42, which has the diameter of about 10 mm and within which the single dimple 14*a* is located at the central part, by the putter face 20, the annular part of the single-dimple portion 42 having an inside diameter of 1–3 mm becomes substantially flat, and is brought into contact with the putter face 20, so that the center of distribution of the reaction force applied to the putter face 20 from the ball 40 substantially coincides with the center of the circular-shaped pressed area 22. Accordingly, a reaction force, which serves as a thrust force for thrusting or moving the ball 40, is generated based on a restoring force of the ball 40 for restoring the pressed area 22 to its original shape, i.e., a part-spherical shape, and acts in a direction which is substantially parallel to the direction P in which the putter head 18 is swung or stroked, on the assumption that the putter face 20 is kept in perpendicular to the direction P during the stroke of the putter head 18. The ball 40 runs based on the thrust force in a direction B which is substantially parallel to the direction P of the stroke of the putter head 18, thereby making it possible to putt the ball 40 in a desired direction with an improved stability.

The single-dimple portion 42 serving as the hit portion in the golf ball 40 of the present second embodiment has the single dimple 14*a* at the central part, while the undimpled portion 16 serving as the hit portion in the golf ball 10 of the above-described first embodiment does not have any one of the dimples 14. This means that the golf ball 40 has a smaller area in which the dimples are absent, than that of the golf ball 10, thereby further minimizing a negative aerodynamic effect. Further, the golf ball 40 is advantageous over the golf ball 10, for minimizing a negative sensuous effect. For example, the smaller undimpled area provides a better appearance of the ball. The provision of the single dimple 14*a* in the single-dimple portion 42 provides a better hit sound in a putting stroke, since the ball 40 is hit at the central part of the single-dimple portion 42 at which the single dimple 14*a* is located.

As described above, the size of each single-dimple portion 42 is sufficiently larger than that of the dimple 14*a* which is located within the single-dimple portion 42. In other words, the size of the dimple 14*a*, which does not constitute a part of the spherical outer surface 12, is sufficiently smaller than that of the single-dimple portion 42. Therefore, the above-described substantial coincidence of the center of distribution of the reaction force and the center of the pressed area 22 is made, even where the center of the pressed area 22 does not exactly coincide with the center of the single-dimple portion 42, namely where the ball 40 is not hit at the center of the single-dimple portion 42. This is because the size of the dimple 14*a* located within the single-dimple portion 42 is so small that the direction of the reaction force is kept substantially unchanged even if the center of the pressed area 22 is somewhat deviated from the center of the single-dimple portion 42. Further, as in the golf ball 10 of the first embodiment with the undimpled portions 16, the above-described substantial coincidence is obtained, even where the diameter A of the pressed area 22 is made larger than the diameter of the single-dimple portion 42, namely where some part of the pressed area 22 is not brought in contact with the club face 20.

Figure 8:
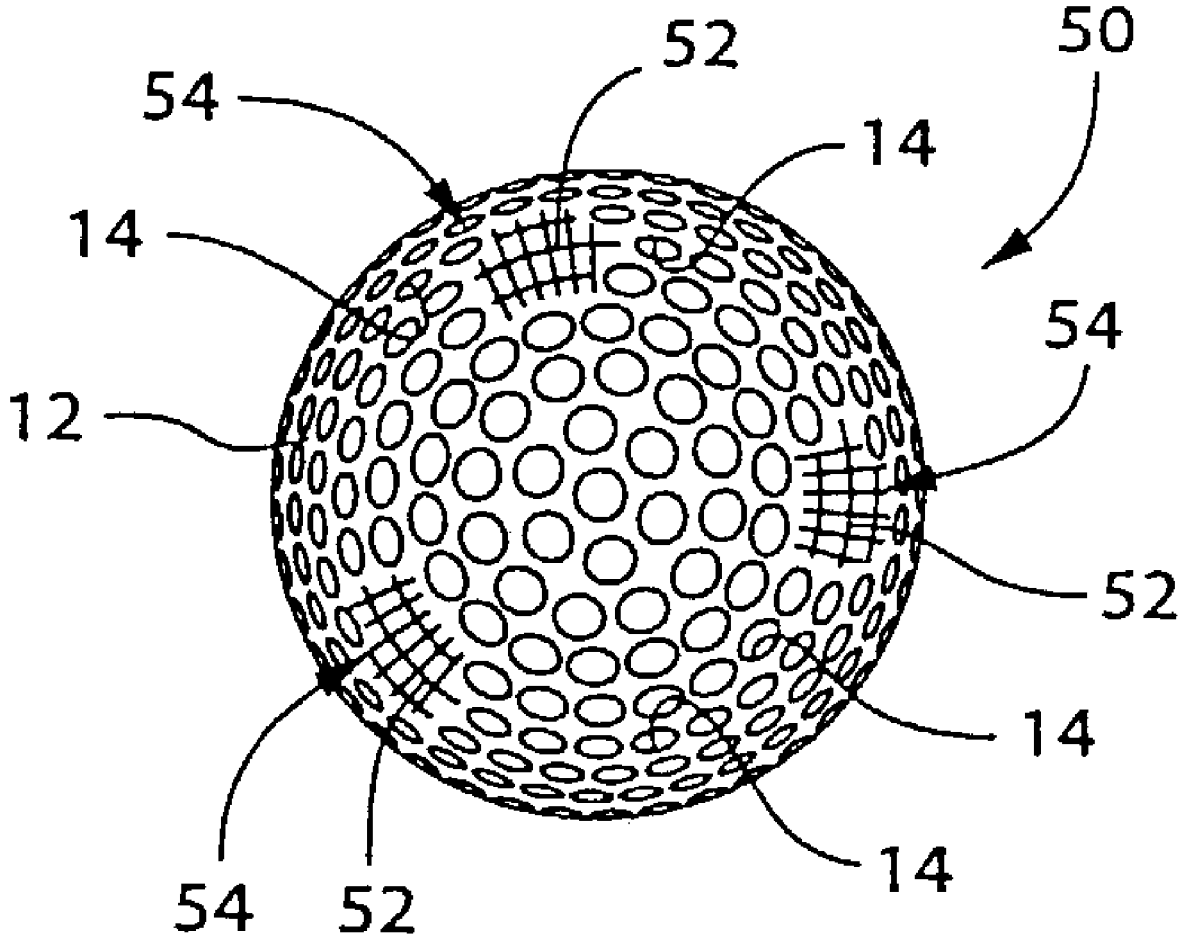
FIG. 8 is a view showing a golf ball according to a third embodiment of this invention.

FIG. 8 shows a golf ball 50 of the third embodiment of the present invention. The golf ball 50 has lattice-arranged groove portions 54 in place of the undimpled portions 16. That is, the spherical outer surface 12 of the golf ball 50 has six lattice-arranged groove portions 54 which are arranged to be symmetrical with each other with respect to the center of the golf ball 50, in addition to the major portion in which the dimples 14 are provided with the spacing interval between adjacent ones of the dimples 14 being not larger than about 1 mm. In each of the six lattice-arranged groove portions 54 (three of which are invisible in FIG. 8), the dimples 14 are absent while a plurality of grooves 52 are formed. Each of the grooves 52 has a width of, for example, about 0.5–1.0 mm which is sufficiently smaller than the diameter of each dimple 14. The grooves 52 are arranged generally in a lattice, in which some of the grooves 52 are parallel to a predetermined direction and spaced apart from each other at a pitch of 2–3 mm between the centers of the adjacent ones, and in which the others of the grooves 52 are parallel to a direction perpendicular to the predetermined direction and spaced apart from each other at a pitch of 2–3 mm between the centers of the adjacent ones. Each lattice-arranged groove portion 54 is dimensioned such that a circle having a diameter of about 10 mm is inscribed in the lattice-arranged groove portion 54. In the present third embodiment, the lattice-arranged groove portions 54 correspond to the hit portions. The ball 50 is put on the green in a preparation for putting the ball 50, such that one of the lattice-arranged groove portions 54 serves as the pressed area 22.

The lattice-arranged groove portion 54 of the ball 50 has the diameter of about 10 mm and the grooves 54 arranged in a lattice. Where the ball 50 is pressed at the lattice-arranged groove portion 54 by the putter face 20, the deviation of the center of balance of the contact area from the center of the pressed area 22 tends to be reduced more than where the ball 50 is pressed at the other portion of the spherical outer surface in which the dimples 14 each having the diameter larger than the width of each groove 52 are formed. Thus, by hitting the ball 50 at the lattice-arranged groove portion 54 in a putting stroke, it is possible to make the center of the pressed area 22 substantially coincide with the center of balance of the contact area, i.e., the center of distribution of the reaction force applied from the ball 50 to the putter face 20. Accordingly, the reaction force, which serves as a thrust force for thrusting or moving the ball 50, is generated based on a restoring force of the ball 50 for restoring the pressed area 22 to its original shape, i.e., a part-spherical shape, and acts in a direction which is substantially parallel to the direction in which the putter head 18 is swung or stroked, so that the ball 50 runs based on the thrust force in a direction which is substantially parallel to the direction of the stroke of the putter head 18, thereby making it possible to putt the ball 50 in a desired direction with an improved stability.

In the golf ball 50 of the present third embodiment, a negative aerodynamic effect is more reduced, owing to the provision of recesses in the form of the grooves 52 in the lattice-arranged groove portion 54, than in the golf ball 50 of the above-described first embodiment having the undimpled portions 16 each constituting a part of the spherical outer surface 12.

In the golf ball 50 of the present third embodiment, the grooves 52 of the lattice-arranged groove portion 54 are arranged in a lattice so as to be symmetrical with each other. The symmetrical arrangement of the grooves 52 further reduces the deviation of the center of distribution of the reaction force from the center of the pressed area 22, where the center of the pressed area 22 is deviated from the center of the lattice-arranged groove portion 54, i.e., where the golf ball 50 is not hit at the center of the lattice-arranged groove portion 54. Thus, the symmetrical arrangement of the grooves 52 is effective to further improve the directional stability of the ball 50 in a putting stroke.

Figure 9:
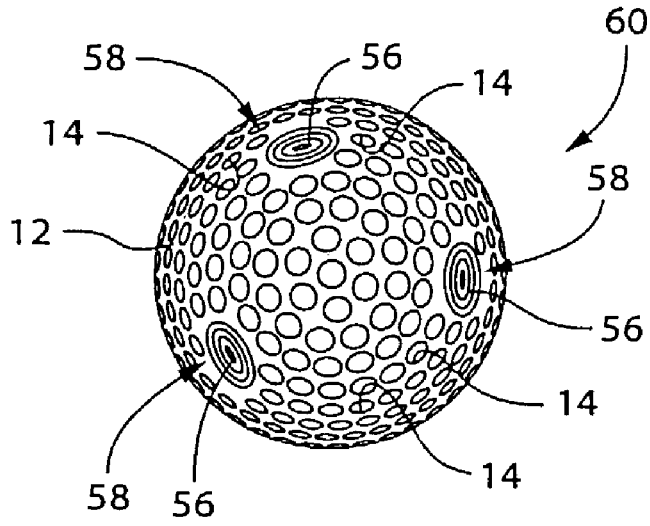
FIG. 9 is a view showing a golf ball according to a fourth embodiment of this invention.

FIG. 9 shows a golf ball 60 of the fourth embodiment of the present invention. The golf ball 60 has annular groove portions 58 in place of the lattice-arranged groove portions 54. That is, the spherical outer surface 12 of the golf ball 60 has six annular groove portions 58 (three of which are invisible in FIG. 9) in each of which a plurality of annular grooves 56 are formed. The annular grooves 56 have respective diameters different from each other, and are positioned relative to each other to be held in a substantially concentric relationship with each other. Each of the annular grooves 56 has a width of, for example, about 0.5–1.0 mm which is sufficiently smaller than the diameter of the dimples 14. The concentric annular grooves 56 are radially spaced apart from each other at a pitch of, for example, about 1–2 mm between the centers of the radially adjacent ones. The six annular groove portions 58 have a diameter of, for example, about 10 mm, and arranged to be symmetrical with each other with respect to the center of the golf ball 60. In the present fourth embodiment, the annular groove portions 58 correspond to the hit portions. The ball 60 is put on the green in a preparation for putting the ball 60, such that one of the annular groove portions. 58 serves as the pressed area 22.

Where the ball 60 is pressed at the selected one of the annular groove portions 58 by the putter face 20, the deviation of the center of balance of the contact area from the center of the pressed area 22 tends to be reduced, as the ball 50 of the above-described third embodiment having the lattice-arranged groove portions 54. Thus, by hitting the ball 60 at the annular groove portion 58 in a putting stroke, it is possible to make the center of the pressed area 22 substantially coincide with the center of balance of the contact area, i.e., the center of distribution of the reaction force applied from the ball 60 to the putter face 20, thereby making it possible to putt the ball 60 in a desired direction with an improved stability.

Figure 10:
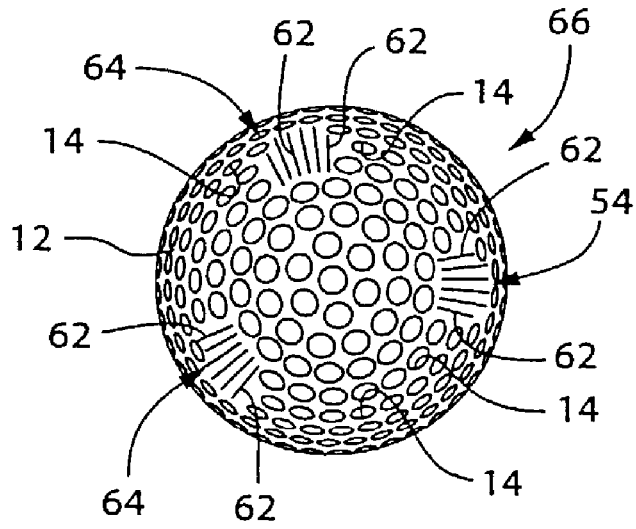
FIG. 10 is a view showing a golf ball according to a fifth embodiment of this invention.

FIG. 10 shows a golf ball 66 of the fifth embodiment of the present invention. The golf ball 66 has parallel groove portions 64 in place of the lattice-arranged groove portions 54. That is, the spherical outer surface 12 of the golf ball 66 has six parallel groove portions 64 (three of which are invisible in FIG. 10) in each of which a plurality of grooves 62 arranged to be parallel to each other are formed. Each of the grooves 62 has a width of, for example, about 0.5–1.0 mm which is sufficiently smaller than the diameter of the dimples 14. The grooves 62 are spaced apart from each other at a pitch of, for example, about 2–3 mm between the centers of the adjacent ones. The six parallel groove portions 64 are dimensioned such that a circle having a diameter of about 10 mm is inscribed in each of the parallel groove portions 64. It is noted that a direction in which the grooves 62 of each parallel groove portion 64 extend is not particularly limited, but is preferably determined such that the directions of the grooves 62 of all of the parallel groove portions 64 are symmetrical with each other with respect to the center of the ball 66.

In the present fifth embodiment, the parallel groove portions 64 correspond to the hit portions. The ball 66 is put on the green in a preparation for putting the ball 66, such that one of the parallel groove portions 64 serves as the pressed area 22. Where the ball 66 is pressed at the selected one of the parallel groove portions 64 by the putter face 20, the deviation of the center of balance of the contact area from the center of the pressed area 22 tends to be reduced, as the ball 50 of the above-described third embodiment having the lattice-arranged groove portions 54. Thus, by hitting the ball 66 at the parallel groove portion 64 in a putting stroke, it is possible to make the center of the pressed area 22 substantially coincide with the center of balance of the contact area, i.e., the center of distribution of the reaction force applied from the ball 66 to the putter face 20, thereby making it possible to putt the ball 66 in a desired direction with an improved stability.

In the golf ball 66 of the present fifth embodiment, the grooves 62 are arranged to be parallel to each other in each of the parallel groove portion 64. This parallel arrangement provides another advantage of preventing displacement of the center of balance of the contact area, by setting the ball 66 on a green such that the grooves 62 are brought in parallel to the vertical or horizontal direction in a preparation for a putting stoke, even if the center of the pressed area 22 is deviated from the center of the parallel groove portion 64 in the putting stroke.

Figure 11:
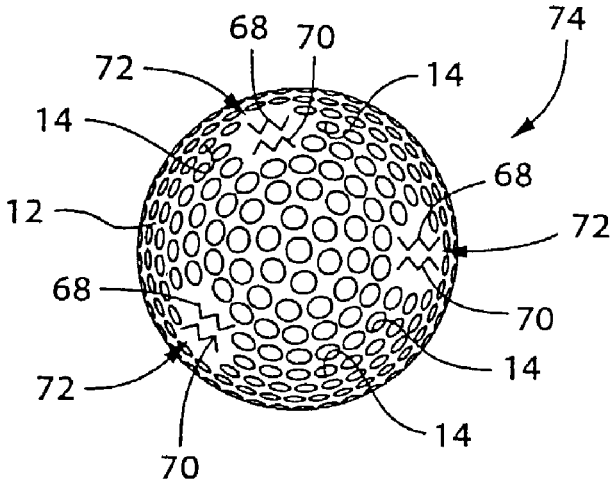
FIG. 11 is a view showing a golf ball according to a sixth embodiment of this invention.

FIG. 11 shows a golf ball 74 of the sixth embodiment of the present invention. The golf ball 74 has groove portions 72 in place of the lattice-arranged groove portions 54. That is, the spherical outer surface 12 of the golf ball 74 has six groove portions 72 (three of which are invisible in FIG. 11) in each of which a W-shaped groove 68 and a M-shaped groove 72 are formed. The W-shaped groove 68 and the M-shaped groove 72 are positioned relative to each other so as to be symmetrical with each other, as shown in FIG. 11. The groove portions 72 provide substantially the same advantages as the lattice-arranged groove portions 54, the annular groove portions 58 and the parallel groove portions 64 of the third, fourth and fifth embodiments. The grooves 68, 70 have the same width as the grooves 52, 56, 62 of these embodiments. The groove portions 72 have the same size as the groove portions 54, 58, 64 of these embodiments.

Figure 12A:
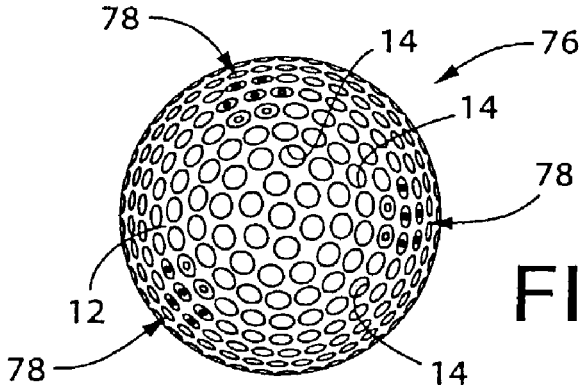
FIG. 12(*a*) is a view showing a golf ball according to a seventh embodiment of this invention.
Figure 12B:
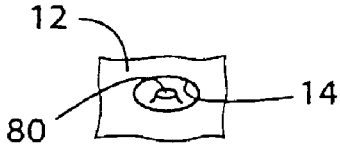
Figure 12C:
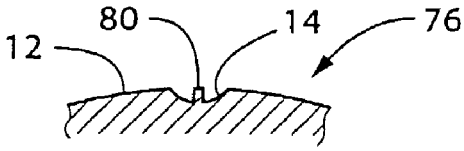

FIG. 12(*a*) shows a golf ball 76 of the seventh embodiment of the present invention. In the golf ball 76, the dimples 14 are formed to be distributed evenly in the entirety of the spherical outer surface 12 as in the conventional golf ball 32. However, the spherical outer surface 12 of the golf ball 76 has six increased contact-area portions 78 (three of which are invisible in FIG. 12(*a*)) which are arranged to be symmetrical with each other with respect to the center of the golf ball 76, and each of which is dimensioned such that a circle having a diameter of about 10 mm is inscribed in the increased contact-area portion 78. In each of the six increased contact-area portions 78, a columnar protrusion 80 having a circular cylindrical shape is formed in each of the dimples 14 and extends from a bottom of the dimple 14 in a radial direction of the ball 76, as shown in FIG. 12(*b*). The columnar protrusion 80 has, at a distal end thereof, a diameter of about 1–2 mm which is equal to about ¼–½ of the diameter of the dimple 14, and has a concentric relationship with the dimple 14. The distal end of the columnar protrusion 80 has a radial distance from the center of the ball 76, which distance is equal to the radius of the ball 76. Thus, the distal end of the columnar protrusion 80 lies on the same surface as the spherical outer surface 12, as best shown in FIG. 12(*c*) (in which only one of the dimples 14 is shown while the other simples 14 actually located in the vicinity of the shown one are not described in the interest of simplification of the drawing). In the present seventh embodiment, the increased contact-area portions 78 correspond to the hit portions. The ball 76 is put on the green in a preparation for putting the ball 76, such that one of the increased contact-area portions 78 serves as the pressed area 22.

In the increased contact-area portions 78 having the diameter of about 10 mm, the columnar protrusions 80 are formed in the respective dimples 14. Where the golf ball 76 is pressed at the selected one of the increased contact-area portions 78 by the putter face 20, the columnar protrusion 80 constituting a part of area inside each dimple 14, as well as an area surrounding each dimple 14, is brought in contact with the putter face 20, thereby leading to a larger contact area provided in the pressed area 22, than where the ball 76 is pressed at the other portion of the spherical outer surface 12 in which the columnar protrusions 80 are not provided, so that the deviation of the center of balance of the contact area from the center of the pressed area 22 tends to be reduced. Thus, by hitting the ball 76 at the increased contact-area portion 78 in a putting stroke, it is possible to make the center of the pressed area 22 substantially coincide with the center of balance of the contact area, i.e., the center of distribution of the reaction force applied from the ball 76 to the putter face 20. Accordingly, the reaction force, which serves as a thrust force for thrusting or moving the ball 76, is generated based on a restoring force of the ball 76 for restoring the pressed area 22 to its original shape, i.e., a part-spherical shape, and acts in a direction which is substantially parallel to the direction in which the putter head 18 is swung or stroked, thereby making it possible to putt the ball 76 in a desired direction with an improved stability.

In the golf ball 76 of the present seventh embodiment of the invention, a negative aerodynamic effect and a negative sensuous effect such as deterioration of the appearance are more reduced, owing to the provision of the dimples 14 in the increased contact-area portions 78 as well as in the other portions of the spherical outer surface 12, than in the golf ball 10 of the above-described first embodiment having the undimpled portions 16 in which any one of the dimples 14 is not provided.

Figure 13A:
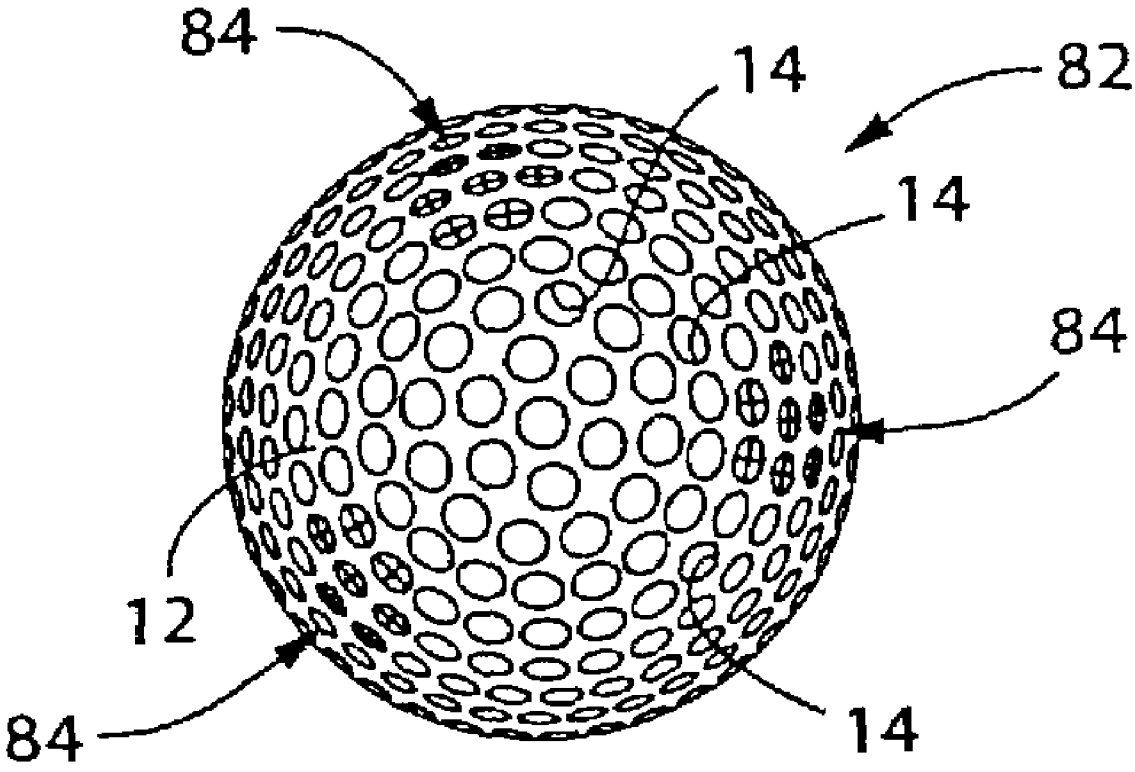
FIG. 13(*a*) is a view showing a golf ball according to an eighth embodiment of this invention.
Figure 13B:
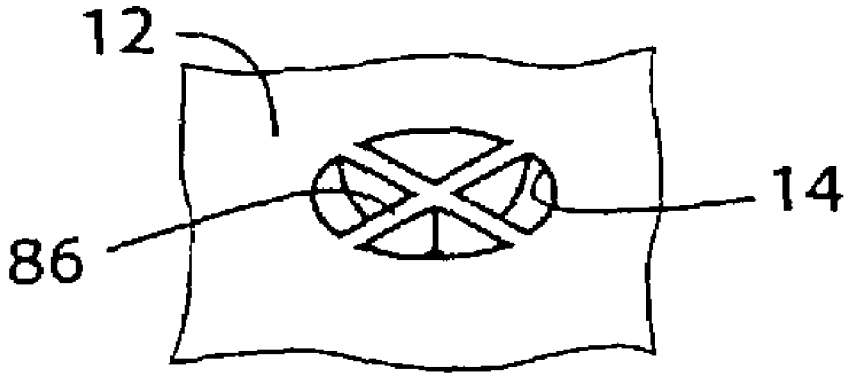

FIG. 13(*a*) shows a golf ball 82 of the eighth embodiment of the present invention. In the golf ball 82, the dimples 14 are formed to be distributed evenly in the entirety of the spherical outer surface 12 as in the conventional golf ball 32. However, the golf ball 82 has six increased contact-area portions 84 (three of which are invisible in FIG. 13(*a*)) which are arranged to be symmetrical with each other with respect to the center of the golf ball 82, and each of which is dimensioned such that a circle having a diameter of about 10 mm is inscribed in the increased contact-area portion 84. In each of the six increased contact-area portions 84, a cross-shaped partition protrusion 86 is formed in each of the dimples 14 and extends from a bottom of the dimple 14 in a radial direction of the ball 82, as shown in FIG. 13(*b*). The cross-shaped partition protrusion 86 consists of two partition walls which are perpendicular to each other and intersect at right angles for dividing a space in the dimple 14 into four segmental spaces. Each of the two partition walls has a thickness of, for example, about 0.5–1.5 mm. The cross-shaped partition protrusion 86 has a distal end whose radial distance from the center of the ball 82 is equal to the radius of the ball 82. Thus, the distal end of the cross-shaped partition protrusion 86 lies on the same surface as the spherical outer surface 12. In the present eighth embodiment, the increased contact-area portions 84 correspond to the hit portions. The ball 82 is put on the green in a preparation for putting the ball 82, such that one of the increased contact-area portions 84 serves as the pressed area 22.

Where the golf ball 82 is pressed at the selected one of the increased contact-area portions 84 by the putter face 20, the cross-shaped partition protrusion 86 constituting a part of an area inside each dimple 14, as well as an area surrounding each dimple 14, is brought in contact with the putter face 20, thereby leading to a larger contact area provided in the pressed area 22, than where the ball 82 is pressed at the other portion of the spherical outer surface 12 in which the cross-shaped partition protrusions 86 are not provided, so that the deviation of the center of balance of the contact area from the center of the pressed area 22 tends to be reduced. Thus, by hitting the ball 82 at the increased contact-area portion 84 in a putting stroke, it is possible to make the center of the pressed area 22 substantially coincide with the center of balance of the contact area, i.e., the center of distribution of the reaction force applied from the ball 82 to the putter face 20. Accordingly, the reaction force, which serves as a thrust force for thrusting or moving the ball 82, is generated based on a restoring force of the ball 82 for restoring the pressed area 22 to its original shape, i.e., a part-spherical shape, and acts in a direction which is substantially parallel to the direction in which the putter head 18 is swung or stroked, thereby making it possible to putt the ball 82 in a desired direction with an improved stability.

In the golf ball 82 of the present eighth embodiment of the invention, a negative aerodynamic effect and a negative sensuous effect such as deterioration of the appearance are more reduced, owing to the provision of the dimples 14 in the increased contact-area portions 84 as well as in the other portions of the spherical outer surface 12, than in the golf ball 10 of the above-described first embodiment having the undimpled portions 16 in which any one of the dimples 14 is not provided.

Figure 14A:
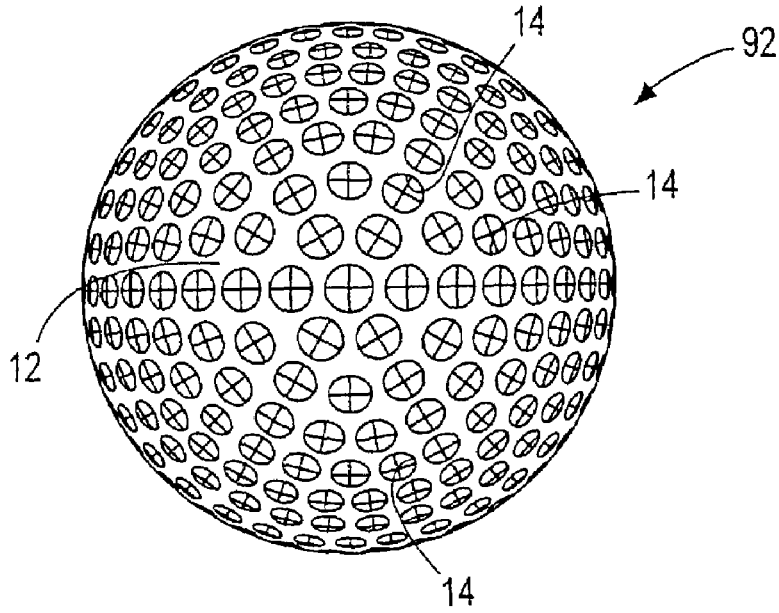
FIG. 14(*a*) is a view showing a golf ball according to a ninth embodiment of this invention.
Figure 14B:
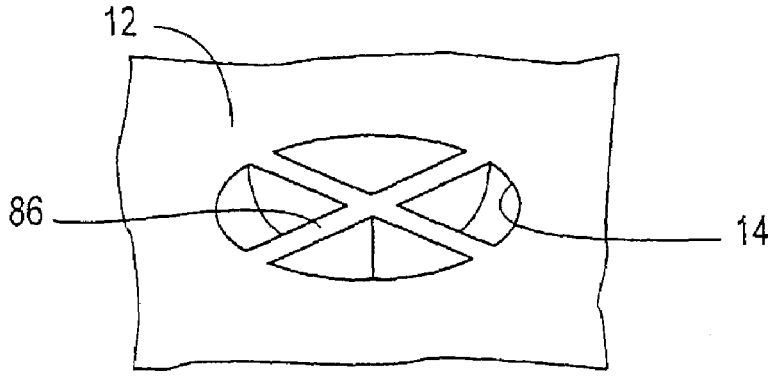

FIG. 14(*a*) shows a golf ball 92 of the ninth embodiment of the present invention. This golf ball 92 is different from the above-described golf ball 82 in that the cross-shape partition protrusions 86 are distributed over the entirety of the spherical outer surface 12. That is, while the protrusions 86 are formed only within the six portions 84 of the spherical outer surface 12 in the golf ball 82, the protrusion 86 are formed on the entirety of the spherical outer surface 12 in this golf ball 92. Accordingly, any part of the spherical outer surface 12 of the ball 92 can serve as a hit portion that should be brought into contact with a club face in a putting stroke. In other words, irrespective of which part of the spherical outer surface 12 of the ball 92 is brought into contact with the club face, the protrusion 86 constituting a part of area inside each dimple 14, as well as an area surrounding each dimple 14, is brought into contact with the club face, thereby providing a sufficiently increased contact area within the pressed area and accordingly minimizing the deviation of the center of balance of the contact area from the center of the pressed area. This means that the golf ball 92 does not require the positional adjustment of a particular portion of the spherical outer surface 12 of the ball 92 relative to the target hole. The elimination of the necessity of the positional adjustment is advantageous, particularly, where a putting stroke has to be done in a non-green area such as an area close to a fringe in which the ball is not allowed to be lifted or picked up, namely, where a putting stroke has to be done without the above-described positional adjustment.

The golf ball 92 constructed according to this ninth embodiment of the invention has another technical advantage owing to the even distribution of the protrusions 86 over the entirety of the spherical outer surface of the golf ball 92. That is, the even distribution of the protrusions 86 as well as the dimples 14 provides a high degree of rectilinear movement of the ball 96 on a putting green. As discussed above, for making the ball run in a player's desired direction, i.e., along a line directed to the target hole, the reaction force generated upon contact of the ball with the club face has to act in a direction substantially parallel to a direction in which the club is swung or stroked. However, strictly speaking, for assuring the running of the ball along the directed line, it is necessary to take account of, in addition to the reaction force upon the contact of the ball with the club face, a resistant force applied from a surface of the putting green to the ball during running of the ball, due to its contact with the surface of the green. If such a resistant force applied from the green surface acts on the running ball asymmetrically with respect to the directed line, the ball would deviate right or left from the directed line. It is considered that the resistant force is influenced by an arrangement of the protrusions and recesses on the spherical outer surface of the golf ball. That is, a tendency of the asymmetrical application of the resistant force can be made smaller where the protrusions and recesses are distributed evenly on the spherical outer surface of the ball, than where the protrusions and recesses are not distributed evenly on the spherical outer surface of the ball.

While the presently preferred embodiments of this invention have been described in detail, for illustrative purpose only, it is to be understood that the present invention is not limited to the details of the illustrated embodiments, but may be otherwise embodied.

While the number of the hit portions (such as the undimpled portions 16, the single-dimple portions 42, the groove portions 54, 58, 64, 72 and the increased contact-area portions 78, 84) is six in the above-illustrated embodiments, the number of the hit portions may be suitably changed while taking account of, for example, a desired degree of directional stability of the ball and a desired amount of lift or upward force acting on the ball during its flight in a golf course. That is, the object of the present invention can be achieved by providing the ball with at least one hit portion which serves as the pressed area 22 in a putting stroke. However, it is preferable to provide the ball with a plurality of hit portions, so that any one of the hit portions can be selected for serving as the pressed area 22, thereby facilitating a preparation for a putting stroke. Where the number of the hit portions is two, the two hit portions preferably may be provided in respective two portions which are diametrically opposite to each other, so as to be symmetrical with each other with respect to the center of the ball, so that a center of balance of the hit portions coincides with the center of the ball. Where the number of the hit portions is three, four or five, too, the hit portions preferably may be arranged such that a center of balance of the hit portions coincides with the center of the ball. It is possible to increase the number of the hit portions as long as deterioration of performance of the ball in a golf course due to the increased number is tolerable.

While the hit portions have the diameter of about 10 mm in the above-illustrated embodiments, the diameter or size of the hit portions may range from about 5 mm to 15 mm, preferably from about 8 mm to 12 mm, depending upon, for example, a degree of elasticity of the ball.

The hit portions of the spherical outer surface 12 of the golf ball of each of the above-illustrated embodiments are identical in form to each other. That is, the each of the hit portions take the form of one of the undimpled portion 16, the single-dimple portion 42, the groove portions 54, 58, 64, 72 and the increased contact-area portions 78, 84. However, the hit portions of the spherical outer surface 12 of the golf ball may be different in form from each other.

The width of the grooves 52 of the lattice-arranged groove portions 54, the annular grooves 56 of the annular groove portions 58, the grooves 62 of the parallel groove portions 64 or the grooves 68, 70 of the groove portions 72 may range, for example, from 0.1 mm to 1.5 mm, depending upon various factors such as a desired degree of directional stability and a desired amount of flight distance during its flight in a golf course. Similarly, the distance between the centers of the adjacent ones of these grooves may range from 0.5 mm to 4 mm, depending upon the various factors. Further, the grooves may have the respective widths different from each other. The distance between the centers of the adjacent grooves does not necessarily have to be constant.

The diameter of the columnar protrusions 80 provided in the increased contact-area portions 78 may be suitably changed as long as the diameter of the columnar protrusions 80 is sufficiently smaller than the diameter of the dimples 14. While the columnar protrusions 80 have the circular cylindrical shape in the above-illustrated embodiment, the columnar protrusions 80 may have a polygonal shape or other shape.

The thickness of the partition walls of the partition protrusions 86 of the increased contact-area portions 84 may be suitably changed as long as the thickness is sufficiently smaller than the diameter of the dimples 14. While the partition protrusions 86 have the cross shape in the above-illustrated embodiment, the partition protrusions 86 may have other shape which is suitable for dividing the space in each dimple 14 into at least two segmental spaces.

The distal ends of the columnar-shaped protrusions 80 or the cross-shaped partition protrusions 86 do not have to lie on the same surface as the spherical outer surface 12, but may be slightly protruded or recessed from the spherical outer surface 12.

It is to be understood that the present invention may be embodied with various other changes, modifications and improvements, which may occur to those skilled in the art, without departing from the spirit and scope of the invention defined by the following claims:

What is claimed is:

1. A golf ball having a predetermined radius, and a spherical outer surface with a multiplicity of dimples formed therein;

wherein said spherical outer surface has at least one hit portion which has a diameter of 5–15 mm and within which a protrusion is formed in each of said dimples, said protrusion having a distal end whose radial distance from the center of the golf ball is equal to said predetermined radius of the golf ball;

wherein said protrusion has a partition wall which divides a space in each of said dimples into a plurality of segmental spaces; and wherein said protrusion has two partition walls which are perpendicular to each other and intersect at right angles for dividing a space in each of said dimples into four segmental spaces.

2. A golf ball according to claim 1, wherein said at least one hit portion consists of a plurality of hit portions which are positioned relative to each other such that a center of balance of said plurality of hit portions coincides with the center of the golf ball.

3. A golf ball according to claim 1, wherein said diameter of said at least one hit portion is 8–12 mm.

4. A golf ball having a predetermined radius, and a spherical outer surface with a multiplicity of dimples formed therein;

wherein a protrusion is formed in each of said dimples, said protrusion having a distal end whose radial distance from the center of the golf ball is equal to said predetermined radius of the golf ball;

wherein said protrusion has a partition wall which divides a space in each of said dimples into a plurality of segmental spaces; and wherein said protrusion has two partition walls which are perpendicular to each other and intersect at right angles for dividing a space in each of said dimples into four segmental spaces.

5. A golf ball according to claim 4, wherein a spacing interval between adjacent ones of said dimples is smaller than 2 mm.

* * * * *